US011428419B2

(12) United States Patent
Ferretti et al.

(10) Patent No.: US 11,428,419 B2
(45) Date of Patent: Aug. 30, 2022

(54) VENT HOOD ASSEMBLY

(71) Applicant: WHIRLPOOL CORPORATION, Benton Harbor, MI (US)

(72) Inventors: Chiara Ferretti, Ancona (IT); Gaetano Paviglianiti, Varese (IT); Matilde Scandroglio, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 211 days.

(21) Appl. No.: 16/940,816

(22) Filed: Jul. 28, 2020

(65) Prior Publication Data

US 2022/0034519 A1 Feb. 3, 2022

(51) Int. Cl.
*F24C 15/20* (2006.01)

(52) U.S. Cl.
CPC ..... *F24C 15/2064* (2013.01); *F24C 15/2021* (2013.01)

(58) Field of Classification Search
CPC ..... F24C 15/20; F24C 15/2042
See application file for complete search history.

(56) References Cited

U.S. PATENT DOCUMENTS

| | | | | |
|---|---|---|---|---|
| D489,805 | S | 5/2004 | Vetter | |
| 8,267,756 | B2 | 9/2012 | Klemm et al. | |
| D865,152 | S | 10/2019 | Kim | |
| 2019/0376694 | A1* | 12/2019 | Xu | B01D 46/40 |
| 2020/0340682 | A1* | 10/2020 | Deng | F24C 15/20 |

FOREIGN PATENT DOCUMENTS

| | | | | | |
|---|---|---|---|---|---|
| CN | 2335064 | Y | * | 8/1999 | |
| CN | 201181040 | Y | * | 1/2009 | |
| CN | 203010705 | U | * | 6/2013 | |
| CN | 203517939 | U | * | 4/2014 | |
| CN | 203628763 | U | * | 6/2014 | |
| CN | 105371327 | A | * | 3/2016 | |
| CN | 205065854 | U | * | 3/2016 | |
| CN | 105737224 | A | * | 7/2016 | |
| CN | 105890012 | A | * | 8/2016 | |
| CN | 106382259 | A | * | 2/2017 | F04D 29/441 |
| CN | 206320818 | U | * | 7/2017 | |
| CN | 107461776 | A | * | 12/2017 | F24C 15/20 |
| CN | 107631337 | A | * | 1/2018 | |
| CN | 107830565 | A | * | 3/2018 | F24C 15/20 |
| CN | 107965830 | A | * | 4/2018 | F24C 15/20 |
| CN | 207378908 | U | * | 5/2018 | |

(Continued)

*Primary Examiner* — Jorge A Pereiro
(74) *Attorney, Agent, or Firm* — Price Heneveld LLP

(57) ABSTRACT

A kitchen vent hood includes a body defining an inclined front face having a vent inlet thereon. A front panel assembly is hingedly coupled with the body and extends along the inclined front face of the body. The front panel assembly includes a vent grate extending across a width of the vent hood body and at least partially covering the vent inlet. A panel bracket extends forward from the vent hood body at a position adjacent to and above the vent grate. An upper panel is coupled with the panel bracket and extends oppositely from the vent grate to define an open space adjacent the front face of the body. A light source is mounted within the panel bracket and is positioned to direct light outwardly therefrom and over the vent grate.

19 Claims, 9 Drawing Sheets

(56) References Cited

FOREIGN PATENT DOCUMENTS

| | | | | | |
|---|---|---|---|---|---|
| CN | 108644843 | A | * | 10/2018 | ..... F24C 15/20 |
| CN | 207962772 | U | * | 10/2018 | |
| CN | 108775609 | A | * | 11/2018 | ..... F24C 15/20 |
| CN | 109028214 | A | * | 12/2018 | ..... F24C 15/2028 |
| CN | 208295993 | U | * | 12/2018 | |
| CN | 208579372 | U | * | 3/2019 | ..... F24C 15/20 |
| CN | 208587946 | U | * | 3/2019 | |
| CN | 208652654 | U | * | 3/2019 | |
| CN | 109595645 | A | * | 4/2019 | |
| CN | 105737224 | B | * | 5/2019 | |
| CN | 209013257 | U | * | 6/2019 | |
| CN | 209042480 | U | * | 6/2019 | |
| CN | 110043936 | A | * | 7/2019 | |
| CN | 209101366 | U | * | 7/2019 | |
| CN | 110145774 | A | * | 8/2019 | |
| CN | 110145776 | A | * | 8/2019 | |
| CN | 110145777 | A | * | 8/2019 | |
| CN | 110631065 | A | * | 12/2019 | |
| CN | 110686290 | A | * | 1/2020 | |
| CN | 111076256 | A | * | 4/2020 | |
| DE | 102007061981 | A1 | * | 6/2009 | ..... F24C 15/20 |
| DE | 102008040433 | A1 | | 1/2010 | |
| DE | 102012207851 | A1 | | 11/2013 | |
| DE | 102012222415 | A1 | * | 6/2014 | ..... F24C 15/2064 |
| DE | 102014208388 | A1 | | 6/2015 | |
| DE | 102015202838 | A1 | | 8/2016 | |
| EP | 1139028 | A2 | * | 10/2001 | ..... F24C 15/20 |
| EP | 1239226 | A2 | * | 9/2002 | ..... F24C 15/20 |
| EP | 1757866 | A2 | | 1/2006 | |
| EP | 2063189 | A2 | | 5/2009 | |
| EP | 2469189 | A2 | * | 6/2012 | ..... F24C 15/2071 |
| EP | 2546578 | A1 | | 7/2012 | |
| EP | 3009747 | A1 | | 4/2016 | |
| GB | 2229378 | A | * | 9/1990 | ..... F24C 15/20 |
| GB | 2249493 | A | * | 5/1992 | ..... F24C 15/20 |
| JP | 2003322377 | A | * | 11/2003 | |
| KR | 20120008469 | U | * | 12/2012 | |
| TR | 201505794 | A | * | 10/2015 | |
| TR | 201820804 | A2 | * | 2/2019 | |
| WO | WO-2020139226 | A2 | * | 7/2020 | ..... F24C 15/20 |

* cited by examiner

VENT HOOD ASSEMBLY

FIELD OF DISCLOSURE

The present disclosure generally relates to a vent hood assembly, and more specifically, to an illuminated vent hood assembly.

BACKGROUND

Vent hoods may include inlets for drawing in air for filtering and expulsion through an outlet and associated ductwork. Many vent hoods further include a light source to illuminate the area below the vent hood assembly. Such light sources are typically positioned along a lowermost portion of the vent hood.

SUMMARY OF THE DISCLOSURE

According to one aspect of the present disclosure, a kitchen vent hood includes a body defining an inclined front face having a vent inlet thereon. A front panel assembly is hingedly coupled with the body and extends along the inclined front face of the body. The front panel assembly includes a vent grate extending across a width of the vent hood body and at least partially covering the vent inlet. A panel bracket extends forward from the vent hood body at a position adjacent to and above the vent grate. An upper panel is coupled with the panel bracket and extends oppositely from the vent grate to define an open space adjacent the front face of the body. A light source is mounted within the panel bracket and is positioned to direct light outwardly therefrom and over the vent grate.

According to another aspect of the present disclosure, a kitchen vent hood includes a body having a front wall, a rear wall, a top wall, a bottom wall, and laterally opposing sidewalls. The front wall is inclined in a forward direction and defines a vent inlet to an interior of the body. A support plate is coupled with the body and defines an opening aligned with the vent inlet. A vent grate is coupled with the support plate and covers the opening and the vent inlet. A first upper panel is coupled with the support plate in a position above the vent grate. A panel bracket is coupled with the support plate between the vent grate and the first upper panel. A second upper panel is coupled with the panel bracket and is aligned with the first upper panel. The panel bracket maintains an open space between the first upper panel and the second upper panel.

According to yet another aspect of the present disclosure, a kitchen vent hood includes a body defining a vent inlet and a vent outlet with an airflow path through the body between the vent inlet and the vent outlet. The body includes a front wall inclined in a forward direction. The vent inlet is defined in the front wall. A support plate is coupled with the front wall of the body and defines an opening aligned with the vent inlet. A vent grate is positioned over the opening and is removeably coupled with the support plate. The vent grate includes a plurality of extruded members extending over the opening in the support plate and defining a plurality of vent spaces therebetween. A panel bracket is coupled with and extends outwardly from the support plate. An upper exterior panel is coupled with and spaced apart from the front wall of the body by the panel bracket. A light source is coupled with the panel bracket and directs light toward the vent grate.

These and other features, advantages, and objects of the present disclosure will be further understood and appreciated by those skilled in the art by reference to the following specification, claims, and appended drawings.

Figure 1:
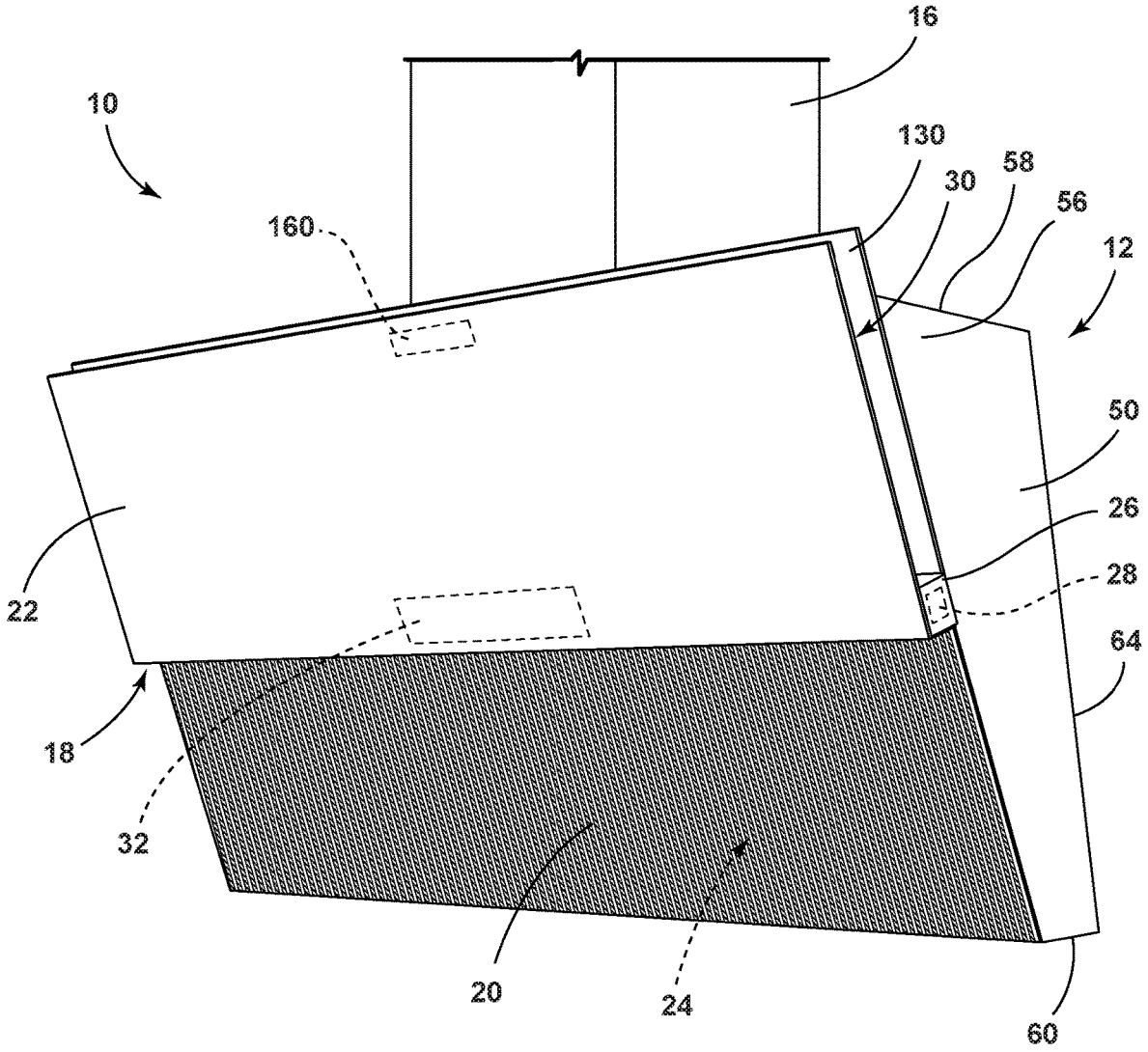
FIG. 1 is a side perspective view of a vent hood assembly, according to various examples.

The components in the figures are not necessarily to scale, emphasis instead being placed upon illustrating the principles described herein, unless otherwise noted.

DETAILED DESCRIPTION

The present illustrated embodiments reside primarily in combinations of method steps and apparatus components related to a vent hood assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-9, reference numeral 10 generally designates a kitchen vent hood including a body 12. The body 12 includes a housing 14 and a vent stack cover 16. The interior housing 14 defines a vent inlet 24. A front panel assembly 18 is coupled with the vent hood body 12 and positioned at a forward incline. The front panel assembly 18 includes a vent grate 20 operably coupled with and extending along a width of the body 12. The vent grate 20 at least partially covers the vent inlet 24. A panel bracket 26 is operably coupled with and extending forward of the vent hood body 12. An upper panel 22 is coupled with the panel bracket 26 and is spaced apart from the vent hood body 12 by a space 30. The space 30 is maintained by the panel bracket 26. A light source 28 is operably coupled with the panel bracket 26 and positioned to direct light toward the vent grate 20. A control interface 32 may be operably coupled with the upper panel 22.

Figure 2:
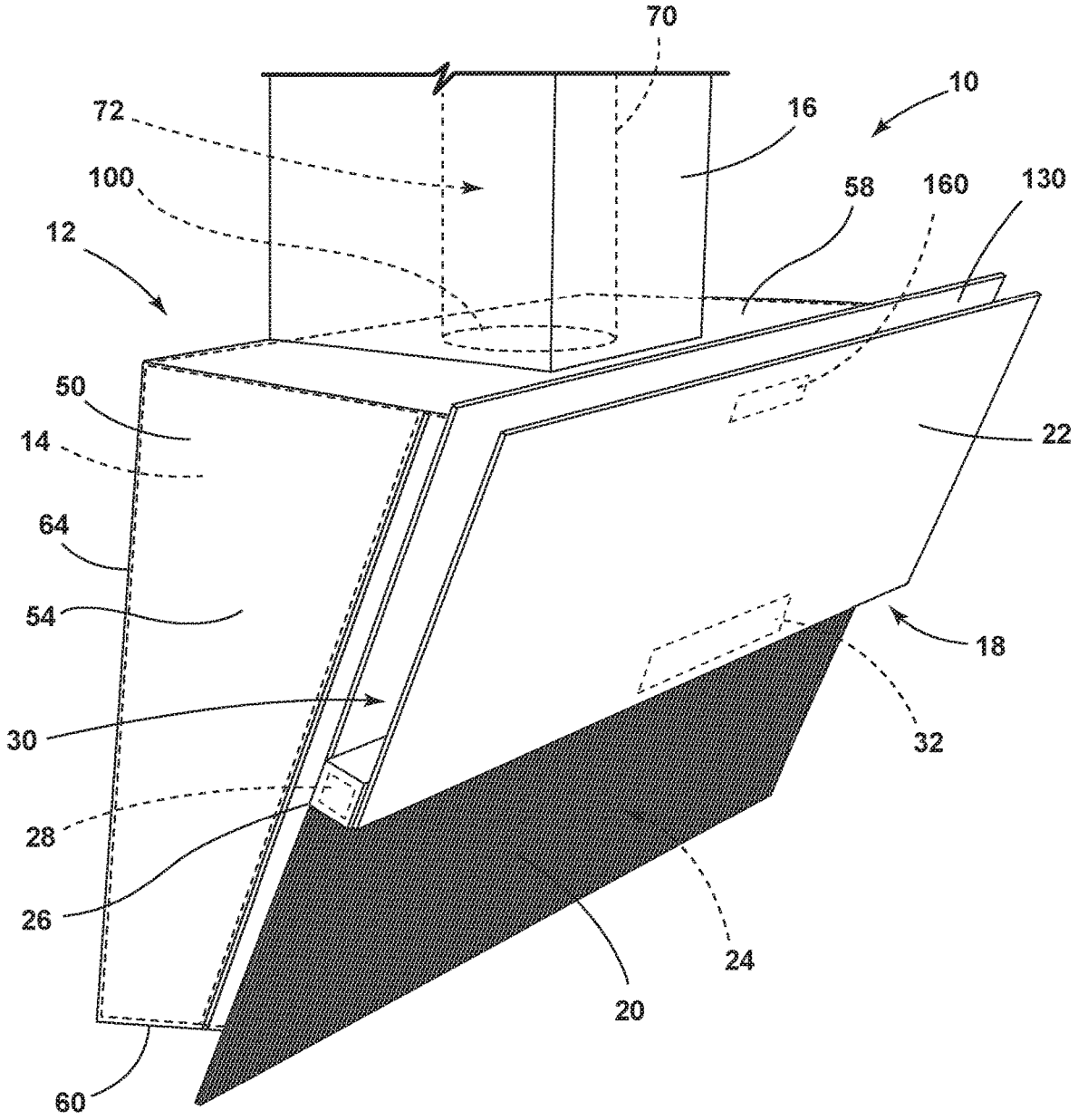
FIG. 2 is a top perspective view of the vent hood assembly of FIG. 1.
Figure 3:
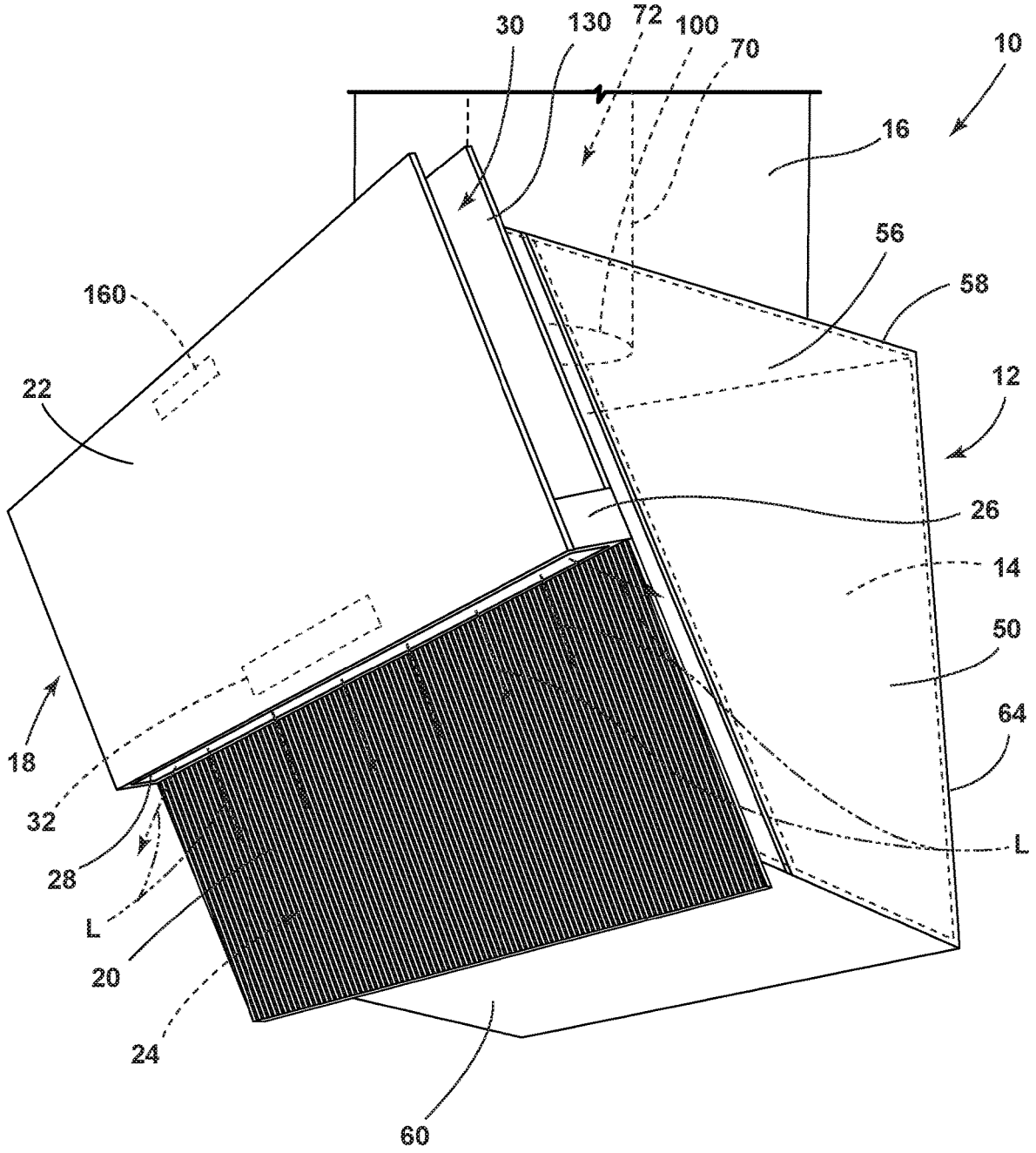
FIG. 3 is a bottom perspective view of the vent hood assembly of FIG. 1.

Referring now to FIGS. 1-3, the front panel assembly 18 is illustrated coupled with the body 12 of the kitchen vent hood 10. The body 12 includes first and second sidewalls 54, 56, a top wall 58, a bottom wall 60, a front wall 62, and a rear wall 64. The body 12 defines a cavity 66 in communication with the vent inlet 24 and at least one vent outlet 100. It will be understood that the cavity 66 may be configured to house mechanical components of a vent hood 10 for drawing air through the vent inlet 24 and directing the air through the vent outlet 100 (e.g., a motor, a frame for supporting the motor, ducts, etc.).

As best shown in FIGS. 2 and 3, a casing 50 may at least partially cover the housing 14 of the body 12. The outer casing 50 is positionable around at least part of the interior housing 14 when the vent hood assembly 10 is assembled. The casing 50 may be removably coupled with the housing 14 using, for example, fasteners and/or adhesives. The casing 50 may be any number of pieces or structural elements configured to be coupled with and/or cover the housing 14 of the body 12. As illustrated, the casing 50 may cover at least the first and second sidewalls 54, 56 of the body 12 and may include at least a top panel integrally formed with the vent stack cover 16. It is contemplated that the vent stack cover 16 may be integrally formed with the casing 50 as a single piece or may be coupled with the casing 50. As illustrated in FIGS. 1-3, the vent stack cover 16 may extend upward from the body 12 and may have a cross-section that is, for example, substantially circular, triangular, square, rectangular, or any other geometric shape. In various examples, the vent stack cover 16 can conceal a duct conduit 70 defining a vent channel 72 therein.

Figure 4:
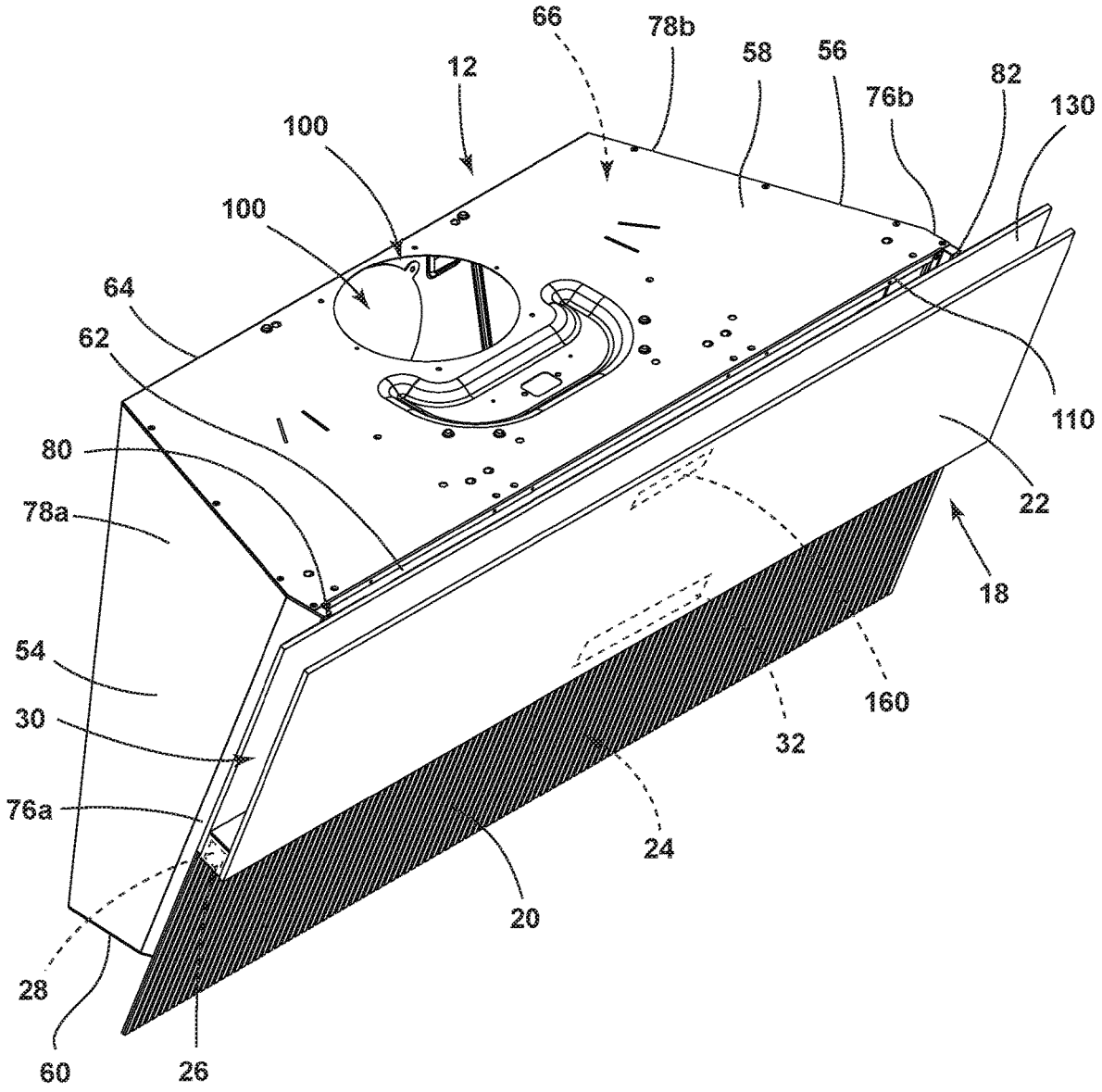
FIG. 4 is a top perspective view of the vent hood assembly of FIG. 1 with an outer casing removed.
Figure 5:
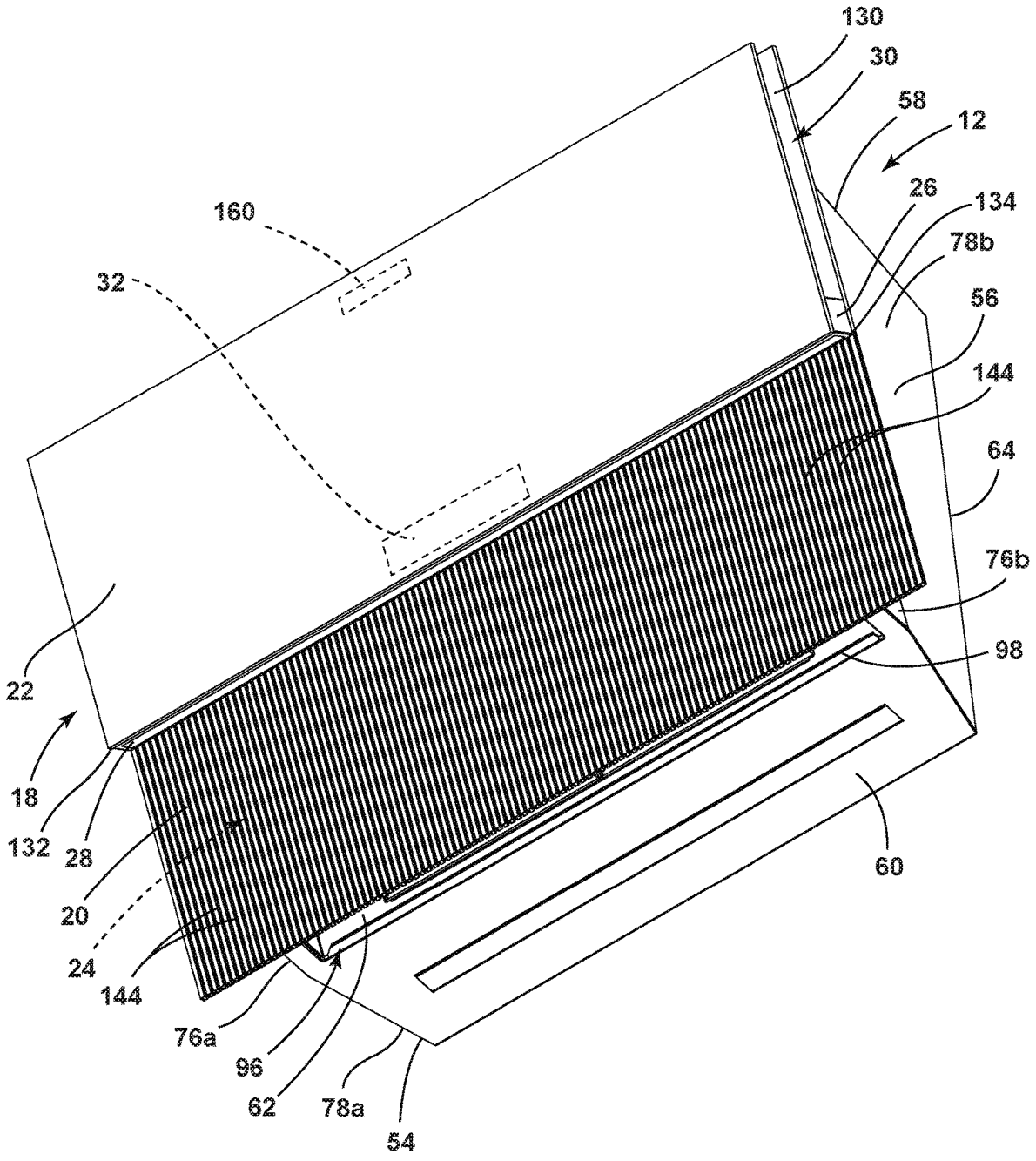
FIG. 5 is a bottom perspective view of the vent hood assembly of FIG. 4.
Figure 6:
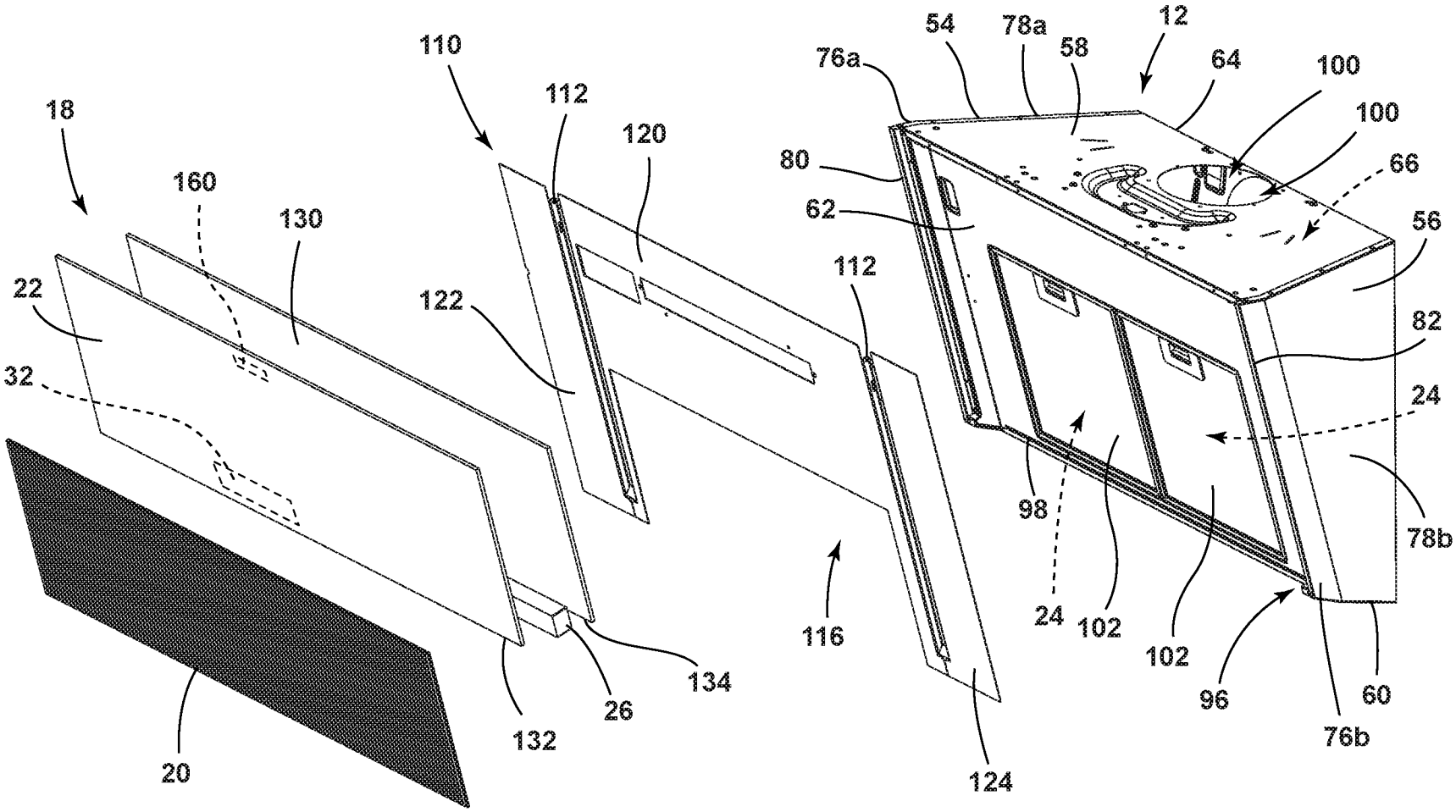
FIG. 6 is an exploded perspective view of the vent hood assembly of FIG. 4.
Figure 7:
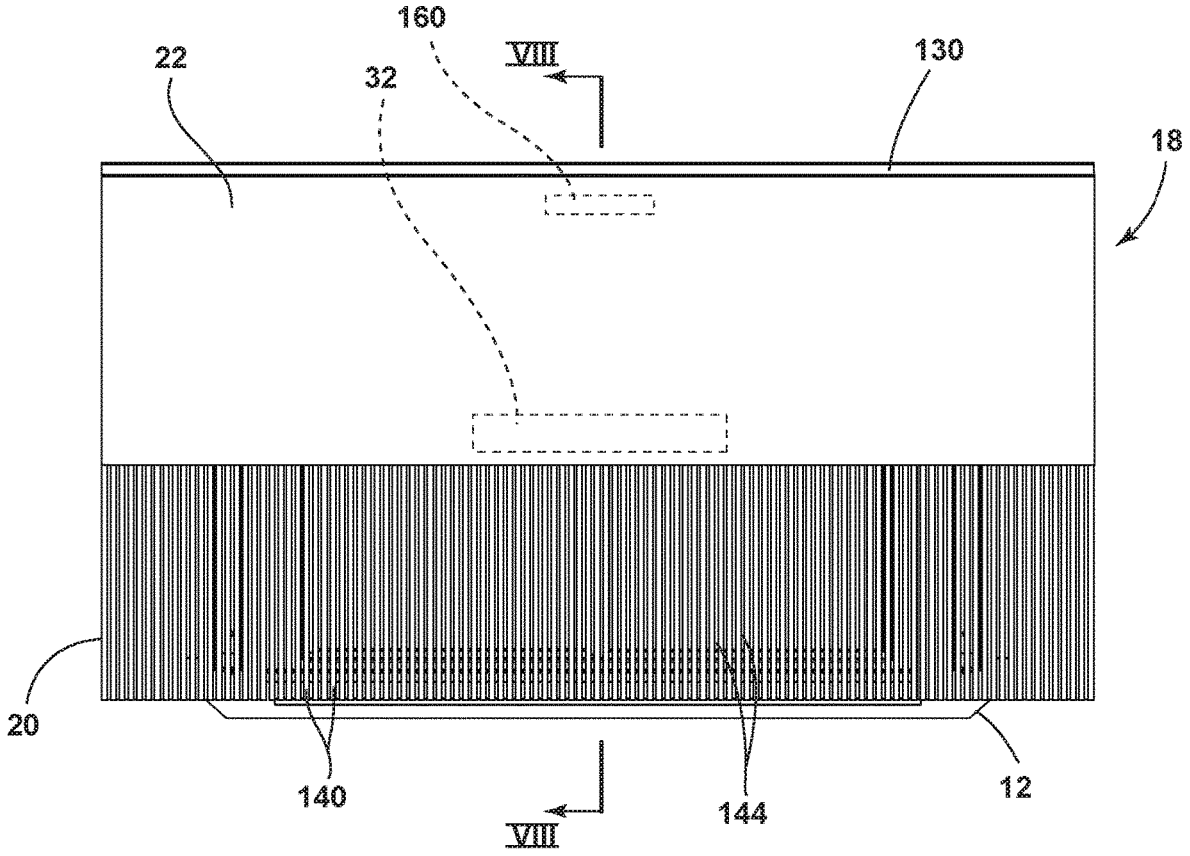
FIG. 7 is a front elevation view of the vent hood assembly of FIG. 4.

Referring now to FIGS. 4-6, each of the first and second sidewalls 54, 56 of the vent hood body 12 may include a forward portion 76*a*, 76*b* integrally formed with a rear portion 78*a*, 78*b*. The forward portion 76*a*, 76*b* of each of the first and second sidewalls 54, 56 may have a substantially trapezoidal shape, and the rear portion 78*a*, 78*b* of each of the first and second sidewalls 54, 56 may be shaped as irregular quadrilaterals. However, it will be understood that each of the portions 76*a*, 76*b*, 78*a*, 78*b* may have a variety of shapes without departing from the scope of the present disclosure.

As illustrated in FIGS. 4 and 6, the rear portion 78*a* of the first sidewall 54 and the rear portion 78*b* of the second sidewall 56 may be configured to taper inward in a direction away from the respective forward portions 76*a*, 76*b*. Each of the forward portion 76*a*, 76*b* of the first and second sidewalls 54, 56 may further include a front edge 80, 82 defined opposite the joinder of the forward portions 76*a*, 76*b* and the rear portions 78*a*, 78*b*. The front edges 80, 82 are configured to be aligned with and spaced apart from the front panel assembly 18, as discussed in more detail elsewhere herein.

The forward portions 76*a*, 76*b* of each of the first and second sidewalls 54, 56 extend generally parallel with each other in a forward direction away from the respective rear portions 78*a*, 78*b* to define respective obtuse angles relative to the respective rear portion 78*a*, 78*b* when viewed from above. It is contemplated that each of the first and second sidewalls 54, 56 may be a single portion extending along a single plane without departing from the scope of the present disclosure. The first and second sidewalls 54, 56 may be positioned to be substantially parallel or may be positioned such that the interior housing 14 tapers rearward from the front wall 62 of the body 12 through the respective rear portions 78*a*, 78*b*.

As best illustrated in FIG. 6, the front wall 62 of the interior housing 14 extends between the first and second sidewalls 54, 56 and may be substantially rectangular. The front wall 62 and the front edges 80, 82 of each of the first and second sidewalls 54, 56 may be positioned at a forward incline in an upward direction and/or with respect to rear wall 64. The forward incline of the front wall 62 is configured such that the top wall 58 extends farther from the rear wall 64 than the bottom wall 60. In other examples, the incline of the front wall 62 may be configured such that the top wall 58 has a cross-section that is larger than the bottom wall 60. The inclined position of the front wall 62 is configured to position the front panel assembly 18 at an incline and may provide improved user accessibility of the front panel assembly 18 and corresponding features (e.g., the light source 28 or the control interface 32).

With continued reference to FIG. 6, the front wall 62 may be at least partially recessed such that the bottom wall 60 of the interior housing 14 defines a lower space 96 proximate a lower edge 98 of the front wall 62. The lower space 96 may have a substantially rectangular shape or may have a substantially trapezoidal shape. In various examples, the lower edge 98 may extend along the entirety of the lower edge 98 of the front wall 62. In other examples, the lower edge 98 may extend only partially along the lower edge 98 of the front wall 62. The lower space 96 may be in communication with the vent inlet 24 or may be defined separately from the vent inlet 24.

The vent inlet 24 may be defined by the front wall 62 of the body 12. The vent inlet 24 may be one of a plurality of vent inlets 24 arranged as a grid or may be a single vent inlet 24. For example, the vent inlet 24 may be one of a plurality of vent inlets 24 arranged in a one by two grid, a two by two grid, or any other reasonably-configured grid array. The vent inlet 24 may be substantially centered on the front wall 62 or may be defined proximate an edge of the front wall 62 (e.g., the lower edge 98). In various examples, the vent inlet 24 may be configured to receive and/or be covered by a filter assembly 102 configured to filter air pulled through the vent inlet 24 and into the cavity 66. The filter assembly 102 may be a permanent filter assembly or may be a replaceable or interchangeable filter assembly or may be otherwise removable for cleaning/maintenance purposes. The recessed configuration of the front wall 62 and/or the arrangement of the vent inlet 24 (e.g., as a plurality of vent inlets 24 arranged in a grid or other grouping) may allow a desired draw of air through the vent inlet 24 and into the cavity 66 of the interior housing 14.

Referring again to FIGS. 4-6, the vent outlet 100 may be defined by any one of the walls 54, 56, 58, 60, 62, 64 of the body 12. For example, the vent outlet 100 may be defined by the top wall 58 and may be configured to be in communication with the duct conduit 70 positioned within an interior of the vent stack 16. Alternatively, the vent outlet 100 may be defined by the rear wall 64 of the interior housing 14. The vent outlet 100 may be defined having any shape (e.g., a circle, triangle, square, etc.) reasonably suited for the outward flow of air and may be defined with any dimensions configured to size. The vent outlet 100 may further be defined as one of a plurality of vent outlets 100. Where the interior housing 14 defines a plurality of vent outlets 100, it is contemplated that all of the vent outlets 100 may be open or some of the vent outlets 100 may be selectively obstructed to account for variations in the placement and/or configuration of the vent hood assembly 10.

Referring still to FIGS. 4-6, the front panel assembly 18 includes the vent grate 20 and the upper panel 22. As illustrated, the upper panel 22 is a first upper panel, and the front panel assembly 18 may further include a second upper panel 130 positioned behind and aligned with the first upper panel 22. The first upper panel 22 may be positioned as an upper exterior panel, and the second upper panel 130 may be positioned as an upper cover panel for a support plate 110. The panel bracket 26 is positioned to space apart the first and second upper panels 22, 130. The support plate 110 is further configured to support at least the first upper panel 22 by way of the panel bracket 26 and the vent grate 20.

As best illustrated in FIG. 6, the support plate 110 is generally planar and couples with the top wall 58 of the body 12, as described below. The support plate 110 may include support brackets 112 positioned on opposing sides of the support plate 110. Each of the support brackets 112 extends from a top edge of the support plate 110 to a bottom edge of the support plate 110. Alternatively, each of the support brackets 112 may extend along a portion of the support plate 110 and may be spaced apart from the edges of the support plate 110.

The support plate 110 defines an opening 116 that aligns with the vent inlet 24 when the support plate 110 is coupled with the body 12. As illustrated, the support plate 110 may include an upper portion 120 and first and second lower legs 122, 124 extending from opposing ends of the upper portion 120 (e.g., the upper portion 120 and the first and second lower legs 122, 124 may be generally arranged to form a U-shaped support plate 110). The upper portion 120 and the first and second lower legs 122, 124 may be integrally formed as a single piece and may define the opening 116 between the first and second lower legs 122, 124. Alternatively, the upper portion 120 and one or both of the first and second lower legs 122, 124 may be coupled together to form the support plate 110 and define the opening 116.

Figure 8:
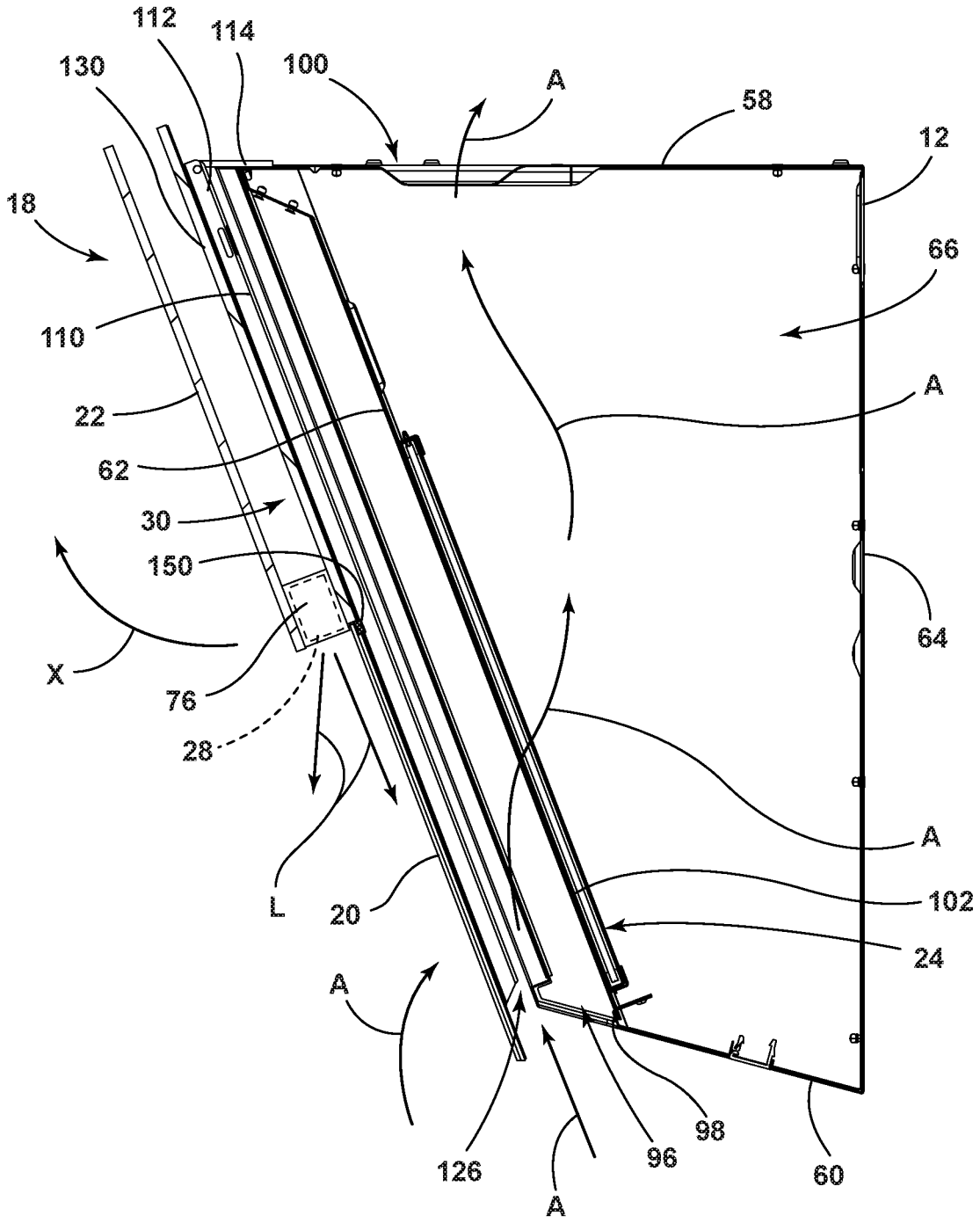
FIG. 8 is a cross-sectional view of the vent hood assembly of FIG. 7 taken along line VIII-VIII.
Figure 9:
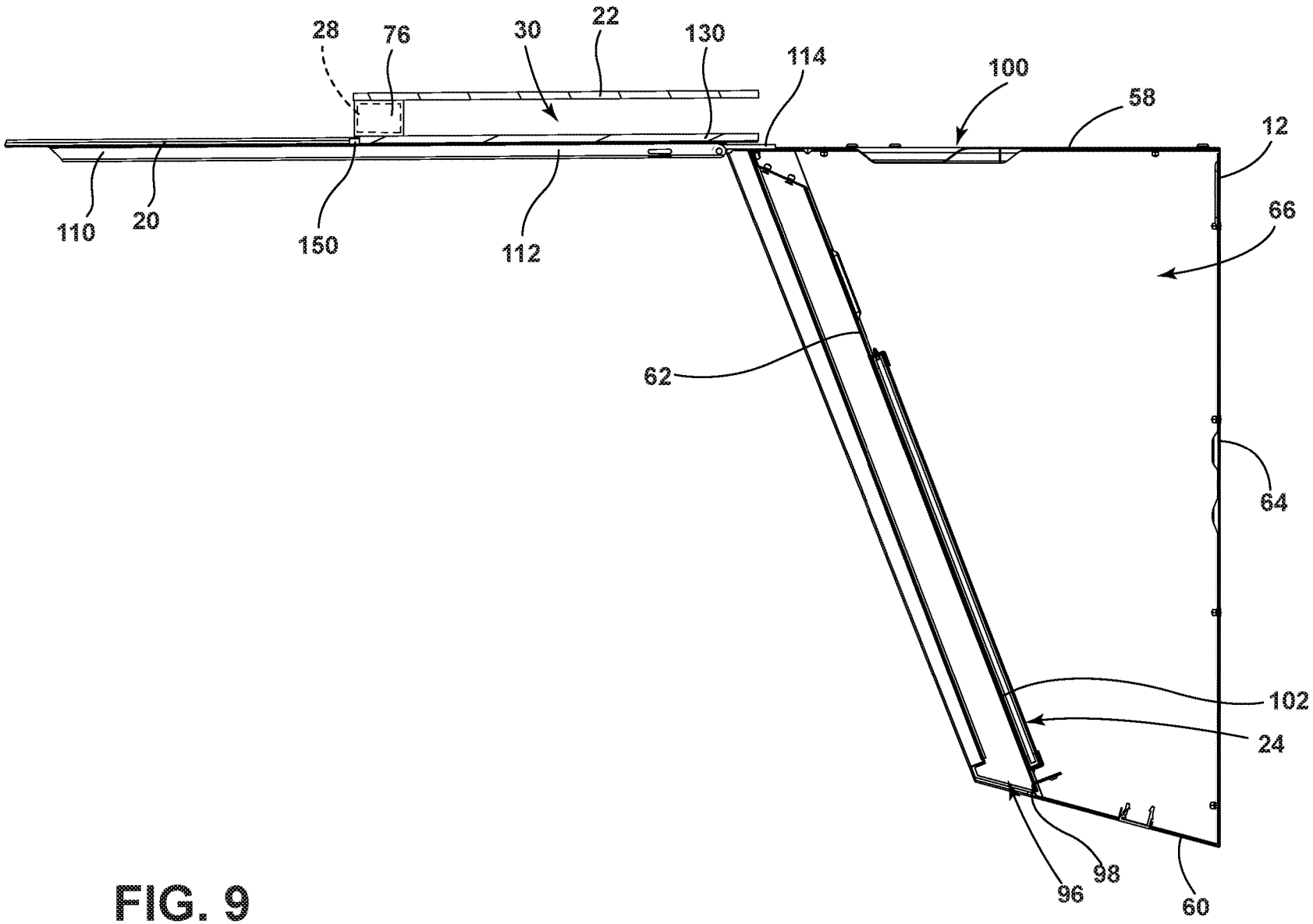
FIG. 9 is a cross-sectional view of the vent hood assembly of FIG. 8 with a front panel assembly in a raised position.

As illustrated in FIGS. 8 and 9, a plurality of hinges 114 may be coupled with the top wall 58 of the body 12 proximate the front wall 62. Each of the plurality of hinges 114 may be further coupled one of the support brackets 112 or may be coupled with another portion of the support plate 110. The support plate 110, and subsequently the front panel assembly 18, rotates about the hinges 114 along the path indicated by arrow X and moves between a lowered position (FIG. 8) and a raised position (FIG. 9). When the support plate 110 is in the lowered position, the support plate 110 is spaced apart from and aligned with the front edges 80, 82 of the first and second sidewalls 54, 56 of the body 12. In the lowered position, the support plate 110 is inclined parallel to and along the front wall 62 of the body 12 and separated from the body 12 by a space 126. The support plate 110, and the front panel assembly 18, may be maintained in the lowered position at the incline illustrated in FIG. 8 by blocks positioned on and/or coupled with an upper portion of the front panel assembly 18 and configured to prevent the front panel assembly 18 from inadvertently moving from the lowered position. In other examples, a hydraulic spring feature, a snap-engagement feature, a stop, or any other feature configured to maintain the support plate 110 parallel to the front wall 62 of the body 12 may be used to maintain the front panel assembly 18 in the lowered position. When the support plate 110 is in the raised position, the vent inlet(s) 24, corresponding filter assemblies 102, and the front wall 62 of the body 12 may be accessible to a user for cleaning and/or maintenance.

Referring now to FIGS. 6, 8, and 9, the front panel assembly 18 further includes the vent grate 20 positioned over at least the opening 116 of the support plate 110 and the vent inlet 24. The vent grate 20 further extends over the first and second lower legs 122, 124 of the support plate 110 and may extend to or beyond the front edges 80, 82 of the side walls 54, 56 and may be coupled with and/or support by the support plate 110. As illustrated, the vent grate 20 extends partially up the support plate 110 to cover the opening 116 and may be configured to leave the lower space 96 unobstructed. It is contemplated that specific dimensions of the vent grate 20 relative to support plate 110 may vary from what is depicted in the Figures and described herein without departing from the scope of the present disclosure.

Referring back to FIG. 7, the vent grate 20 includes a plurality of extruded members 140 extending parallel to one another and spaced along the width of the vent grate 20. The plurality of extruded members 140 may be coupled together by one or more transverse members (to maintain the spacing between the plurality of members 140) and may be coupled with the support plate 110, with another component of the front panel assembly 18 (e.g., with a upper cover panel 130 or with the panel bracket 26). As best illustrated in FIG. 6, the plurality of extruded members 140 may extend vertically and may be positioned at an incline parallel with the incline of the front wall 62 of the body 12 and the support plate 110. The plurality of members 140 are spaced apart to define a plurality of vent spaces 144. The plurality of vent spaces 144 are defined to be in communication with the opening 116 and/or the vent inlet 24. The plurality of vent spaces 144 may be evenly or unevenly sized and extend parallel with the plurality of vent members 140.

As shown in FIGS. 8 and 9, the vent grate 20 may further be coupled with the support plate 110 by one or more attachment members 150 configured to allow the vent grate 20 to be removed. For example, the vent grate 20 may be coupled with the support plate 110 by a releasable hinge or other releasable attachment feature 150. In various examples, the vent grate 20 may be formed of an enamel-covered aluminum. In other examples, the vent grate 20 may be formed of any other material configured to allow easy removal of the vent grate 20. In some examples, the vent grate 20 may be of a dishwasher-safe material and/or construction.

When the front panel assembly 18 is in the lowered position (FIG. 8) and the vent grate 20 is attached to the support plate 110, air flows along an airflow path illustrated by arrows A. The airflow path A pulls air through and behind the vent grate 20. The airflow path A then extends through the cavity 66 of the body 12 and directs the air through the vent outlet(s) 100. It is contemplated that ducts, fans, motors, and/or any other interior components may affect the positioning and/or direction of the airflow path A without departing from the scope of the present disclosure.

As illustrated in FIGS. 4-6, the front panel assembly 18 may further include an upper cover panel 130 positioned above the vent grate 20. A lower edge 134 of the upper cover panel 130 is aligned with a top edge of the vent grate 20. The lower edge 134 of the upper cover panel 130 may abut the vent grate 20 or may be spaced apart from the vent grate 20. The upper cover panel 130 may be formed of glass or metal and may extend upward past the top wall 58 of the body 12 (FIGS. 1-3). The upper cover panel 130 may be substantially the same width as the vent grate 20. However, it is contemplated that the upper cover panel 130 may extend beyond the width of the vent grate 20 or may have a width that is less than the width of the vent grate 20 without departing from the scope of the present disclosure.

As previously introduced, the front panel assembly 18 further includes the panel bracket 26 positioned between the upper cover panel 130 and the vent grate 20 such that the lower edge 134 of the upper cover panel 130 abuts the panel bracket 26. The panel bracket 26 may be coupled with the support plate 110. For example, the panel bracket 26 may be coupled with the upper portion 120 of the support plate 110 and may extend above the opening 116. Alternatively, the panel bracket 26 may be coupled with one of the upper cover panel 130 and the vent grate 20.

The panel bracket 26 may have a substantially rectangular or square cross-section and may be positioned such that one side of the panel bracket 26 is abuts with the support plate 110. The panel bracket 26 extends outward from the support plate 110. In various examples, the panel bracket 26 may be configured to support one or more of the upper exterior panel 22, the vent grate, and the upper cover panel 130.

As best illustrated in FIGS. 3 and 8, the panel bracket 26 houses a light source 28. The light source 28 may be any light source or combination of light sources including, but not limited to, a light bar, single light emitting diode (LED), or a plurality of LEDs. In various examples, the panel bracket 26 may be configured to operate as a light guide or may be configured to support a light guide coupled with the light source 28. The light source 28 is configured to be supported by or received along or within the panel bracket 26 and is positioned to illuminate outwardly from the panel bracket 26 in a downward direction that is at least partially directed toward the vent grate 20 and past the vent grate 20 to illuminate an area beneath the vent hood 10. In other words, the light source 28 is positioned and/or configured to direct light L toward or along the vent grate 20. The vent grate 20 is configured to direct the light L in a geometric pattern downward from the vent hood assembly 10. The directing of the light L from the light source 28 from above the vent grate 20 and the inclined position of the front panel assembly 18 may provide improved lighting for areas below the vent hood assembly 10. In various examples, the vent grate 20 may be additionally configured to direct the light L in a geometric pattern as the light L passes along and through the vent grate 20.

Referring again to FIGS. 4-6, a lower edge 132 of the upper exterior panel 22 of the front panel assembly 18 is operably coupled to the panel bracket 26. The upper exterior panel 22 may be at least partially supported by the panel bracket 26. For example, the upper exterior panel 22 may be coupled with the panel bracket 26 using fasteners, adhesive, or any other coupling method. The upper exterior panel 22 is positioned parallel to and spaced apart from the upper cover panel 130. The panel bracket 26 maintains the spacing between the upper cover panel 130 and the upper exterior panel 22, thereby defining a space 30 therebetween. As illustrated, the upper exterior panel 22 may be of glass. However, it will be understood that the upper exterior panel 22 may be of any material providing a desired aesthetic without departing from the scope of the present disclosure. The panel bracket 26 is shaped to position the upper exterior panel 22 at the incline of the support plate 110 and the front wall 62 of the body 12. The incline of the upper exterior panel 22 may provide improved accessibility for a user to clean and maintain the upper exterior panel 22.

In various examples, the upper exterior panel 22 may include indicia 160. The indicia 160 may be any combination of images, symbols, letters, numbers, characters, etc. and may be coupled with or integrally formed with the material of the upper exterior panel 22. For example, the indicia 160 may be etched into the material of the upper exterior panel 22, may be painted, printed, or stamped on the upper exterior panel 22, or may be adhered to the front exterior panel 22 using an adhesive. As illustrated, the indicia 160 may be positioned at a top of the upper exterior panel 22. However, it is contemplated that the indicia 160 may be positioned anywhere on the upper exterior panel 22. It is also contemplated that the indicia 160 may be positioned in other areas of the vent hood assembly 10 (e.g., on an edge of the vent grate 20, on the panel bracket 26, etc.) without departing from the scope of the present disclosure.

As previously introduced, control interface 32 may be coupled or integrally formed with the upper exterior panel 22. The control interface 32 may be positioned proximate the lower edge 132 of the upper exterior panel 22. The control interface 32 may comprise a plurality of user inputs in the form of buttons or touch-activated "buttons" (e.g., defined by separate capacitive touch sensors in areas corresponding with specified functions or in similarly designated areas of a single, relatively larger capacitive touch array or sensor) configured to receive user input for the vent hood assembly 10. The positioning of the control interface 32 on the upper exterior panel 22 and the incline of the upper exterior panel 22 may provide easier access to a user operating and general access to the vent hood assembly 10 and may allow packaging of electronic components within the bracket 26 with those associated with light source 28. The control interface 32 may be configured to selectively actuate various components of the vent hood assembly 10. For example, the control interface 32 may be used to adjust and/or control whether light L is emitted, or the intensity and/or color of light emitted by the light source 28 or may be used to adjust and/or control a fan assembly of the vent hood assembly 10. The control interface 32 being positioned on and/or integrated with the upper exterior panel 22 may provide improved access for a user.

Additional aspects of the present disclosure are described in the following paragraphs and all possible combinations thereof. According one such aspect of the present disclosure, kitchen vent hood may include a body defining an inclined front face having a vent inlet thereon. A front panel assembly may be hingedly coupled with the body and may extend along the inclined front face of the body. The front panel assembly may include a vent grate extending across a width of the vent hood body and at least partially covering the vent inlet. A panel bracket may extend forward from the vent hood body at a position adjacent to and above the vent grate. A n upper panel may be coupled with the panel bracket and may extend oppositely from the vent grate to define an open space adjacent the front face of the body. A light source may be mounted within the panel bracket and may be positioned to direct light outwardly therefrom and over the vent grate.

According to another aspect, a body may include an interior housing defining an inclined front face and a vent inlet. An outer casing may be coupled with the interior housing. A vent stack may define an airflow outlet of an air path through the vent inlet and the interior housing.

According to another aspect, a kitchen vent hood may include a support plate coupling a vent grate and a panel bracket with a body and defining an opening aligned with a vent inlet.

According to another aspect, a support plate may include support brackets positioned on opposing sides of an opening. The support plate may be coupled with a body of a kitchen vent hood at the support brackets.

According to another aspect, a vent grate may be removably coupled with a support plate.

According to another aspect, a vent grate may include a plurality of extruded members extending away from a panel bracket over an opening and defining a plurality of vent spaces therebetween. A light source may be further positioned to direct light at least partially over the plurality of members and the plurality of vent spaces.

According to another aspect, a front panel assembly includes a control interface extending along an integral portion of an upper panel aligned with a panel bracket.

According to another aspect, a kitchen vent hood may include a body including front wall, a rear wall, a top wall, a bottom wall, and laterally opposing sidewalls. The front wall may be inclined in a forward direction and may define a vent inlet to an interior of the body. A support plate may be coupled with the body and may define an opening aligned with the vent inlet. A vent grate may be coupled with the support plate and may cover the opening and the vent inlet. A first upper panel may be coupled with the support plate in a position above the vent grate. A panel bracket may be coupled with the support plate between the vent grate and the first upper panel. A second upper panel may be coupled with the panel bracket and may be aligned with the first upper panel. The panel bracket may maintain an open space between the first upper panel and the second upper panel.

According to another aspect, a kitchen vent hood may include a light source coupled with a panel bracket. The light source may direct light over and past a vent grate.

According to another aspect, each of laterally opposing sidewalls may include a front edge spaced apart from a support plate. The support plate may include support brackets configured to be coupled with hinges positioned on a top wall of a body. The support plate may be movable between a raised position and a lowered position.

According to another aspect, a front wall and a vent inlet may be accessible when a support plate is in a raised position.

According to another aspect, a vent grate may be removably coupled with a support plate.

According to another aspect, a vent hood assembly may include an indicia integrally disposed along a portion of a second upper panel.

According to another aspect, a vent hood assembly may include a control interface extending along an integral portion of a second upper panel. The control interface may include at least one touch-activated control element.

According to another aspect, a kitchen vent hood may include a body defining a vent inlet and a vent outlet with an airflow path through the body between the vent inlet and the vent outlet. The body may include a front wall inclined in a forward direction. The vent inlet may be defined in the front wall. A support plate may be coupled with the front wall of the body and may define an opening aligned with the vent inlet. A vent grate may be positioned over the opening and may be removeably coupled with the support plate. The vent grate may include a plurality of extruded members extending over the opening in the support plate and defining a plurality of vent spaces therebetween. A panel bracket may be coupled with and may extend outwardly from the support plate. An upper exterior panel may be coupled with and spaced apart from the front wall of the body by the panel bracket. A light source may be coupled with the panel bracket and may direct light toward the vent grate.

According to another aspect, a vent grate may be arranged with a plurality of extruded members extending away from a panel bracket. A light source may direct light along the plurality of extruded members of the vent grate.

According to another aspect, a kitchen vent hood may include upper cover panel coupled with a support plate. An upper exterior panel may be spaced apart from the upper cover panel.

According to another aspect, a vent grate may be aligned with a lower edge of an upper exterior panel.

According to another aspect, a body of a kitchen vent hood defines laterally opposite sidewalls. A support plate includes support brackets hingedly coupled with a top wall of the body. The support plate may be moveable between a raised position and a lowered position. A support plate may be arranged parallel to and spaced apart from the sidewalls in the lowered position.

According to another aspect, a kitchen vent hood may include a control interface extending along an integral portion of an upper panel. The control interface may be configured to selectively actuate a light source.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A kitchen vent hood, comprising:

a body defining an inclined front face having a vent inlet;

a front panel assembly hingedly coupled with the body and extending along the inclined front face of the body, wherein the front panel assembly includes a vent grate extending across a width of the vent hood body and at least partially covering the vent inlet;

a panel bracket extending forward from the vent hood body at a position adjacent to and above the vent grate;

an upper panel coupled with the panel bracket and extending oppositely from the vent grate to define an open space adjacent the front face of the body; and a light source mounted within the panel bracket and positioned to direct light outwardly therefrom and over the vent grate; and further comprising a support plate coupling the vent grate and the panel bracket with the body and defining an opening aligned with the vent inlet.

2. The kitchen vent hood of claim 1, wherein the body includes:

an interior housing defining the inclined front face and the vent inlet;

an outer casing coupled with the interior housing; and a vent stack defining an airflow outlet of an air path through the vent inlet and the interior housing.

3. The kitchen vent hood of claim 1, wherein the support plate further includes support brackets positioned on opposing sides of the opening, the support plate being coupled with the body at the support brackets.

4. The kitchen vent hood of claim 1, wherein the vent grate is removably coupled with the support plate.

5. The kitchen vent hood of claim 1, wherein:

the vent grate includes a plurality of extruded members extending away from the panel bracket over the opening and defining a plurality of vent spaces therebetween; and the light source is further positioned to direct the light at least partially over the plurality of members and the plurality of vent spaces.

6. The kitchen vent hood of claim 1, wherein the front panel assembly further includes:

a control interface extending along an integral portion of the upper panel aligned with the panel bracket.

7. A kitchen vent hood, comprising:

a body including front wall, a rear wall, a top wall, a bottom wall, and laterally opposing sidewalls, wherein the front wall is inclined in a forward direction and defines a vent inlet to an interior of the body;

a support plate coupled with the body and defining an opening aligned with the vent inlet;

a vent grate coupled with the support plate and covering the opening and the vent inlet;

a first upper panel coupled with the support plate in a position above the vent grate;

a panel bracket coupled with the support plate between the vent grate and the first upper panel; and a second upper panel coupled with the panel bracket and aligned with the first upper panel, the panel bracket maintaining an open space between the first upper panel and the second upper panel.

8. The kitchen vent hood of claim 7, further comprising a light source coupled with the panel bracket, wherein:

the light source directs light over and past the vent grate.

9. The kitchen vent hood of claim 7, wherein:

each of the laterally opposing sidewalls includes a front edge spaced apart from the support plate; and the support plate includes support brackets configured to be coupled with hinges positioned on the top wall of the body, the support plate movable between a raised position and a lowered position.

10. The kitchen vent hood of claim 9, wherein the front wall and the vent inlet are accessible when the support plate is in the raised position.

11. The kitchen vent hood of claim 7, wherein the vent grate is removably coupled with the support plate.

12. The kitchen vent hood of claim 11, further comprising:

an indicia integrally disposed along a portion of the second upper panel.

13. The kitchen vent hood of claim 7, further comprising a control interface extending along an integral portion of the second upper panel, wherein:

the control interface includes at least one touch-activated control element.

14. A kitchen vent hood, comprising:

a body defining a vent inlet and a vent outlet with an airflow path through the body between the vent inlet and the vent outlet, the body including a front wall inclined in a forward direction, the vent inlet being defined in the front wall;

a support plate coupled with the front wall of the body and defining an opening aligned with the vent inlet;

a vent grate positioned over the opening, removeably coupled with the support plate, and including a plurality of extruded members extending over the opening in the support plate and defining a plurality of vent spaces therebetween;

a panel bracket coupled with and extending outwardly from the support plate; and an upper exterior panel coupled with and spaced apart from the front wall of the body by the panel bracket; and a light source coupled with the panel bracket and directing light toward the vent grate.

15. The vent hood of claim 14, wherein:

the vent grate is arranged with the extruded members extending away from the panel bracket; and the light source directs the light along the plurality of extruded members of the vent grate.

16. The kitchen vent hood of claim 14, further comprising an upper cover panel coupled with the support plate, wherein:

the upper exterior panel is spaced apart from the upper cover panel.

17. The vent hood of claim 14, wherein the vent grate is aligned with a lower edge of the upper exterior panel.

18. The kitchen vent hood of claim 14, wherein:

the body further defines laterally opposing side walls; and the support plate includes support brackets hingedly coupled with a top wall of the body and moveable between a raised position and a lowered position, the support plate arranged parallel to and spaced apart from the side walls in the lowered position.

19. The kitchen vent hood of claim 14, further comprising a control interface extending along an integral portion of the upper exterior panel, wherein:

the control interface is configured to selectively activate the light source.

* * * * *